US006145200A

United States Patent [19]

Jorna et al.

[11] Patent Number: 6,145,200

[45] Date of Patent: Nov. 14, 2000

[54] SHAVING APPARATUS

[75] Inventors: Cornelis J. Jorna; Johannes A. M. Van Hout, both of Drachten, Netherlands

[73] Assignee: U.S. Philips Corporation, New York, N.Y.

[21] Appl. No.: 09/276,174

[22] Filed: Mar. 25, 1999

[30] Foreign Application Priority Data

Mar. 27, 1998 [EP] European Pat. Off. ..... 98200966

[51] Int. Cl.[7] ..... B26B 19/14

[52] U.S. Cl. ..... 30/43.6; 30/43.4; 30/346.51

[58] Field of Search ..... 30/43.4, 43.5, 30/43.6, 346.51

[56] References Cited

U.S. PATENT DOCUMENTS

| | | | |
|---|---|---|---|
| 3,748,731 | 7/1973 | Kuiken et al. | 30/43.6 |
| 3,844,033 | 10/1974 | Yonkers | 30/43.6 |
| 3,890,705 | 6/1975 | Tietjens | 30/43.6 |
| 4,087,909 | 5/1978 | Naemura | 30/43.6 |
| 4,168,570 | 9/1979 | Bakker et al. | 30/43.6 |
| 4,257,161 | 3/1981 | Bijl et al. | 30/43.6 |
| 4,675,998 | 6/1987 | Thijsse | 30/43.6 |
| 4,910,869 | 3/1990 | Labrijn | 30/43.6 |
| 5,983,502 | 11/1999 | Geertsma et al. | 30/43.6 |

FOREIGN PATENT DOCUMENTS

| | | | |
|---|---|---|---|
| 0074684 | 3/1983 | European Pat. Off. | B26B 19/14 |

*Primary Examiner*—Hwei-Siu Payer
*Attorney, Agent, or Firm*—Ernestine C. Bartlett

[57] ABSTRACT

A shaving apparatus having an external cutting member and an internal cutting member, which is rotationally drivable with respect to said external cutting member, which internal cutting member is supported on the external cutting member both by an axial and a radial bearing means, the internal cutting member being in axially interlocking engagement with the external cutting member, the internal cutting member and the external cutting member, the shaving apparatus further having a drive member for driving the internal cutting member. In operation, in order to minimize the frictional losses between the internal and the external cutting member, the drive member exerts on the internal cutting member exclusively a force for rotationally driving the internal cutting member, while the drive member does not exert any axial force on the internal cutting member.

6 Claims, 3 Drawing Sheets

SHAVING APPARATUS

BACKGROUND OF THE INVENTION

The invention relates to a shaving apparatus having at least one circular cutting unit which comprises an external cutting member and an internal cutting member, which is rotationally drivable with respect to said external cutting member, which internal cutting member is supported on the external cutting member both by an axial and a radial bearing means, the internal cutting member being in axially interlocking engagement with the external cutting member, the internal cutting member and the external cutting member having cooperating cutting edges for severing hairs, and the shaving apparatus further having a motor provided with a drive member for driving the internal cutting member.

Such a shaving apparatus is known from EP-A2-0 074 684. For the correct cutting of hairs it is necessary that the so-called cutting gap between the cooperating edges of the internal cutting member and the external cutting member is as small as possible. Until now this was achieved by also subjecting the drive member for rotationally driving the internal cutting member to a spring load in an axial direction. As a result of this, the internal cutting member engages against the external cutting member under a given pre-load, i.e. the cutting edges of the internal cutting member are urged against the cutting edges of the external cutting member with a given force. This was necessary because the cutting forces produced during hair cutting are directed in such a way that the cooperating cutting edges tend to be moved apart. The spring load of the cutting member prevents the gap between the cutting edges from becoming too large during cutting. However, this spring load also produces a comparatively high friction between the cooperating cutting edges. In order to reduce this friction EP-A2-0 074 684 proposes to provide the internal cutting member with an axial bearing surface which cooperates with an axial bearing surface of the external cutting member. Thus, it is achieved that the axial spring load of the drive member is transmitted to the external cutting member via these axial bearing surfaces, which is deemed to result in a minimal cutting gap. In the example shown in FIG. 6 of EP-A2-0 074 684 the internal cutting member engages in the external cutting member in an interlocked fashion. Since the drive member also transmits an axial force to the external cutting member via the internal cutting member, the internal cutting member also engages non-positively with the external cutting member. The axial force still causes a frictional loss via the bearing surfaces, particularly because the frictional forces at the cooperating cutting edges lie at a comparatively large distance from the axis of rotation and thus give rise to a loss of torque.

SUMMARY OF THE INVENTION

It is an object of the invention to reduce the frictional losses between the internal cutting member and the external cutting member.

To this end, the invention is characterized in that in operation the drive member exerts on the internal cutting member exclusively a force for rotationally driving the internal cutting member, while the drive member does not exert any axial force on the internal cutting member.

Since the drive member no longer exerts an axial force on the internal cutting member. the friction between the internal cutting member and the external cutting member is minimal. The internal cutting member now engages in the external cutting member exclusively in an interlocked fashion and no longer in a non-positive manner. The frictional losses are minimal, which is particularly important in the case of rechargeable shavers.

It is to be noted that a rotationally drivable cutting member is also meant to be such a cutting member which is drivable with an oscillatory rotation.

In a preferred embodiment the internal cutting member is supported on the external cutting member by means of a flexible bearing means. During hair cutting the cutting forces tend to cause tilting of the internal cutting member with respect to the external cutting member. The bearing means should cope with this tilting. Owing to the flexible bearing means a self-positioning of the cutting members with respect to one another is achieved. A uniform load distribution on the bearing surfaces of the bearing means is obtained and, as a consequence, a uniform wear of the bearing surfaces. This prolongs the lifetime.

A preferred embodiment of a shaving apparatus having the flexible bearing means is characterized in that the external cutting member has a central bearing shaft which extends in an axial direction and the internal cutting member has a central bearing bush journalled on the bearing shaft, the bearing shaft being partly formed as a flexible pin. The flexible pin allows the internal cutting member to adjust itself in an optimum manner with respect to the external prediction. A uniform load on the axial bearing surfaces is obtained. Concentrated peripheral loading of the bearing surface is avoided. Moreover, the contact between the cooperating cutting elements is more uniform. A flexible pin can be formed, for example, by a pin of small diameter.

A further embodiment is characterized in that the axial drive member is axially spring-loaded and has an axial bearing surface for exerting an outwardly directed force exclusively on the external cutting member. As a result of this, the entire cutting unit is resiliently depressible and is also pivotable without an axial force being exerted on the internal cutting member by the drive member. The fact that the cutting unit is depressible and pivotable is preferred to achieve a good compliance of the cutting unit to the skin during shaving.

BRIEF DESCRIPTION OF THE DRAWINGS

An embodiment of the invention will now be described in more detail, by way of example, with reference to the drawings. In the drawings

DESCRIPTION OF THE PREFERRED EMBODIMENTS

Figure 1:
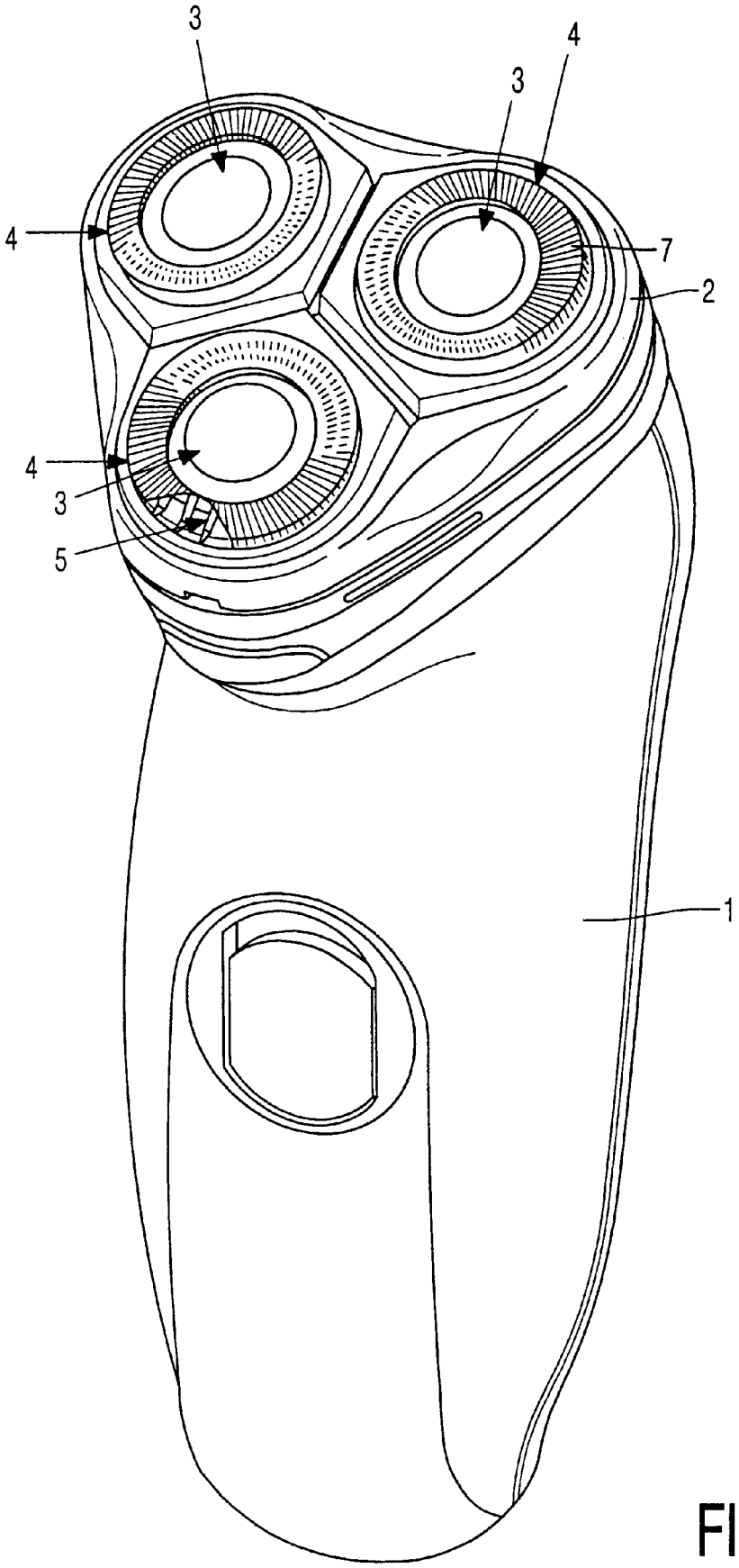
FIG. 1 is a perspective view of a shaving apparatus having three shaving units.

The shaving apparatus shown in FIG. 1 has a housing 1 having a holder 2 which is detachable from the housing or which is pivotable with respect to the housing. The holder holds three cutting units 3, also referred to as shaving heads.

Figure 2:
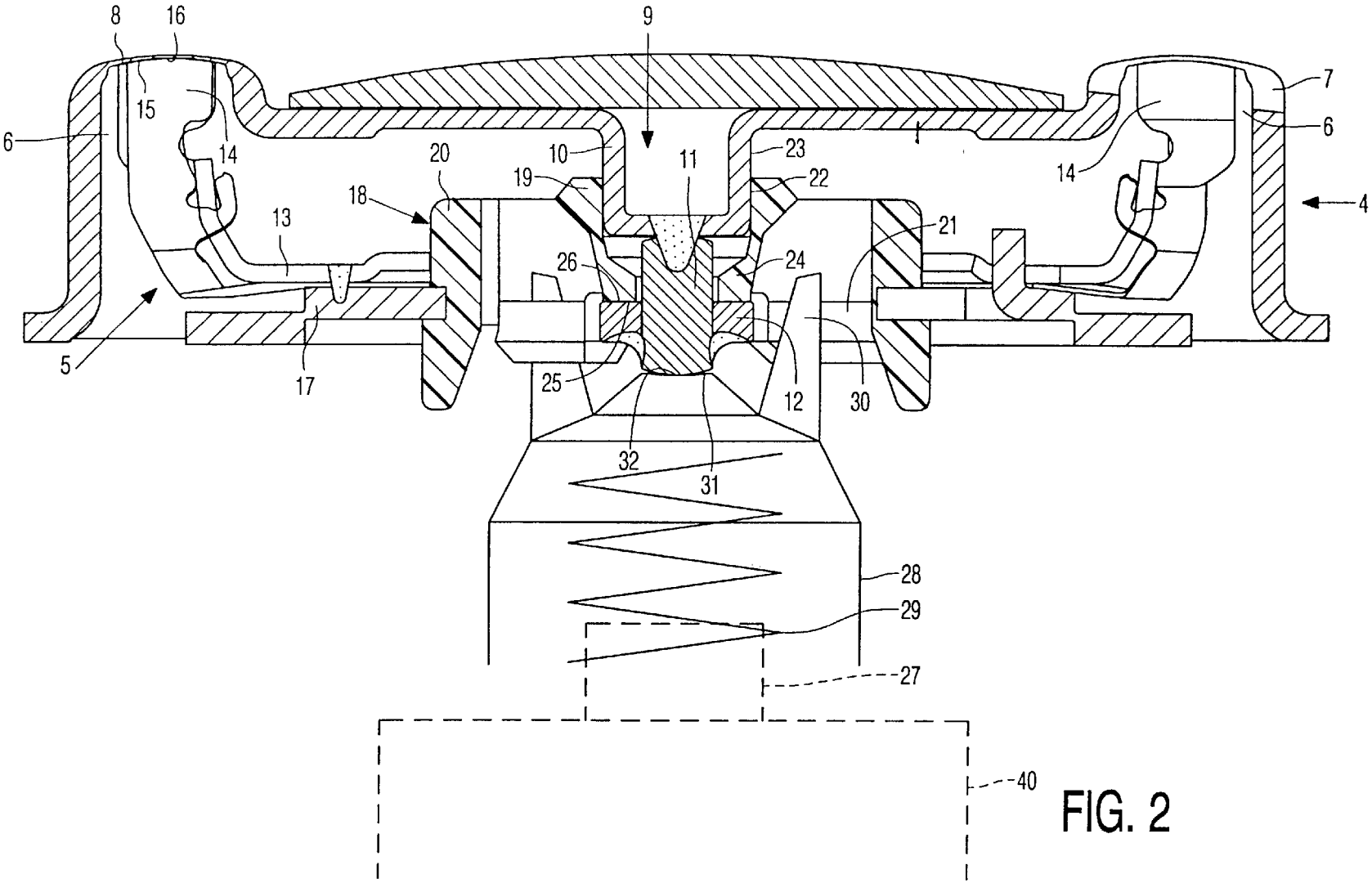
FIG. 2 is a cross-sectional view of a first example of a shaving unit as shown FIG. 1, in FIG. 3 is a cross-sectional view of a second example of a shaving unit as shown in FIG. 1.

The first example of a cutting unit 3 shown in FIG. 2 comprises an external hair cutting member 4 and an internal hair cutting member 5, which is rotationally drivable with respect to said external hair cutting member. The internal hair cutting member is driven by a motor 40 accommodated in the housing.

The external cutting member 4, which is shaped as a circular cap, is formed with a circular groove 6. The bottom wall and the upright side walls are formed with a plurality of slit-shaped hair-entry apertures 7 oriented substantially radially with respect to the center of the cap, between which apertures lamellae 8 extend. The external cutting member 4 has a central bearing shaft 9, which extends in an axial direction. The bearing shaft 9 is formed by a protrusion 10 and a pin 11 with a clamping ring 12 fitted thereon.

The internal cutting member 5 comprises a central portion 13 having cutting elements 14 at its circumference. The ends of these cutting elements 14 have cutting edges 15, which cooperate with cutting edges 16 of the lamellae 8 for severing hairs which project through the hair-entry apertures 7. The central portion 13 is secured to a plate 17 provided with an annular central coupling member 18. The coupling member 18 is formed by a bearing bush 19 and a surrounding ring 20. The ring 20 is connected to the bearing bush 19 by means of spokes 21.

The internal cutting member 5 is rotatable with respect to the external cutting member 4. For this purpose, the bearing bush 19 is journalled on the bearing shaft 9. The radial bearing means is formed by the bearing surfaces 22 and 23 of the bearing bush 19 and the protrusion 10, respectively. The internal cutting member 5 engages in the external cutting member 4 with some clearance, preferably 2–10 $\mu$m. For this purpose, the bearing bush 19 has an inwardly directed collar 24 having an axial bearing surface 25, which cooperates with an axial bearing surface 26 of the clamping ring 12. Furthermore, the cutting edges 15 and 16 can also be regarded as cooperating bearing surfaces.

The rotationally driven outgoing shaft 27 has a spring-loaded coupling shaft 28. A spring 29 urges the coupling shaft 28 towards the external cutting member 4. The coupling shaft 28 has a plurality of coupling fingers 30 which engage between the spokes 21 of the coupling member 18. Thus, the internal cutting member 5 is rotated or rotated in an oscillatory fashion with respect to the external cutting member 4. The coupling shaft 28 further has an axial bearing surface 31 which is in contact with an axial bearing surface 32 of the pin 11 of the bearing shaft 9. Thus, the spring-loaded coupling shaft 28 acts exclusively on the external cutting member 4 and not on the internal cutting member 5. As a result of this, the entire cutting unit 3 is resiliently depressible. It is to be noted that this resilient depressibility can also be obtained by other means than the spring-loaded coupling shaft. An example of such other means are resilient elements having one end fixedly connected to the housing or a part of the housing and having another end which resiliently engages with a lower edge of the external cutting member 4.

Figure 3:
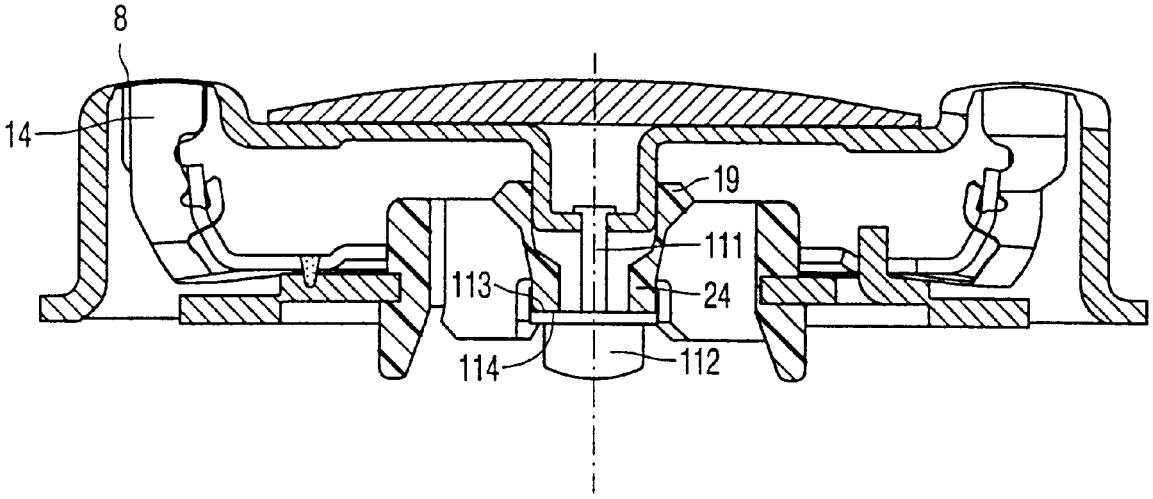
Figure 4:
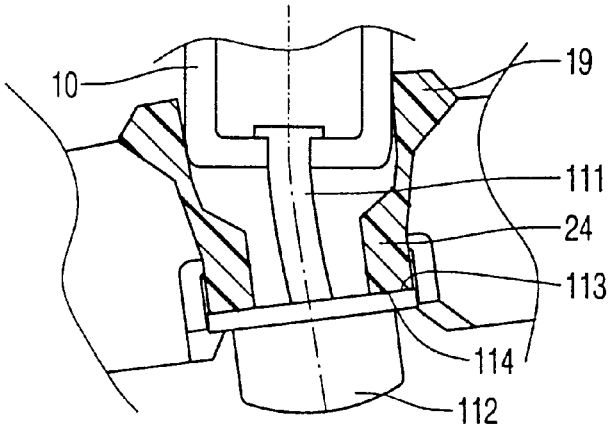
FIG. 4 shows a detail of a bearing means between the cutting members of the shaving unit shown in FIG. 3.

In the example shown in FIG. 3 the bearing means of the internal cutting member 5 with respect to the external cutting member 4 is a flexible bearing means. For this purpose, the pin 111 has a diameter which is comparatively small with respect to the internal diameter of the collar 24 of the bearing bush 19. For the axially interlocking engagement of the internal cutting member 5 in the external cutting member 4 the bearing shaft 9 is provided with a knob 112 instead of a clamping ring 12, as in the example shown in FIG. 2. During cutting of a hair a force is exerted on the cutting element 14, as a result of which a concentrated peripheral load could be exerted on the axial bearing surfaces of the bearing shaft, particularly those of the knob 112. Owing to the thin flexible pin 111 the cooperating axial bearing surfaces 113 and 114 of the knob 112 and the collar 24 better engage with one another, as a result of which a uniform load is exerted on the bearing means. This is illustrated in FIG. 4, in which the tilt has been exaggerated for the sake of clarity.

What is claimed is:

1. A shaving apparatus having at least one circular cutting unit which comprises an external cutting member and an internal cutting member, which is rotationally drivable with respect to said external cutting member, which internal cutting member is supported on the external cutting member both by an axial and a radial bearing means, the internal cutting member being in axially interlocking engagement with the external cutting member, the internal cutting member and the external cutting member having cooperating cutting edges for severing hairs, and the shaving apparatus further having a motor provided with a drive member for driving the internal cutting member, wherein in operation the drive member exerts a force on the internal cutting member for rotationally driving the internal cutting member but does not exert any axial force on the internal cutting member.

2. A shaving apparatus as claimed in claim 1, wherein the internal cutting member is supported on the external cutting member by a flexible bearing.

3. A shaving apparatus as claimed in claim 2, wherein the external cutting member has a central bearing shaft which extends in an axial direction and the internal cutting member has a central bearing bush journalled on the bearing shaft, said bearing shaft being partly formed as a flexible pin.

4. A shaving apparatus as claimed in claim 3, wherein a free end of the bearing shaft of the external cutting member has an axial bearing surface adapted to cooperate with an axial bearing surface of the drive member.

5. A shaving apparatus as claimed in claim 1, wherein the drive member is axially spring-loaded and has an axial bearing surface for exerting an outwardly directed force exclusively on the external cutting member.

6. A shaving apparatus as claimed in claim 5, wherein a free end of a bearing shaft of the external cutting member has an axial bearing surface adapted to cooperate with the axial bearing surface of the drive member.

* * * * *